US007313838B2

(12) United States Patent
Long et al.

(10) Patent No.: US 7,313,838 B2
(45) Date of Patent: Jan. 1, 2008

(54) POWERED CLEANER/POLISHER

(75) Inventors: David C. Long, Racine, WI (US); Edward L. Paas, Los Altos, CA (US); John R. Wietfeldt, Franksville, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/723,074

(22) Filed: Nov. 26, 2003

(65) Prior Publication Data

US 2004/0103490 A1 Jun. 3, 2004

Related U.S. Application Data

(60) Provisional application No. 60/430,735, filed on Dec. 3, 2002.

(51) Int. Cl.
*A47L 11/12* (2006.01)

(52) U.S. Cl. ..... 15/22.2; 15/4; 15/50.2

(58) Field of Classification Search ..... 15/4, 15/22.1, 22.2, 24, 29, 97.1, 98, 49.1, 50.1, 15/50.2, 52.2
See application file for complete search history.

(56) References Cited

U.S. PATENT DOCUMENTS

| | | | | |
|---|---|---|---|---|
| 1,117,722 A | | 11/1914 | Sweetland | |
| 2,107,636 A | | 2/1938 | Kingman | 15/122 |
| 2,590,913 A | * | 4/1952 | Adams | 15/103 |
| 3,024,487 A | | 3/1962 | Jones et al. | 15/524 |
| 3,251,087 A | | 5/1966 | Platt | 15/98 |
| 3,380,095 A | | 4/1968 | Piper | 15/97 |
| 3,444,576 A | | 5/1969 | Daane | 15/28 |
| 3,445,877 A | * | 5/1969 | Stout | 15/98 |
| 3,655,444 A | | 4/1972 | Young | 134/6 |
| 3,657,759 A | | 4/1972 | Sawyer | 15/98 |
| 3,715,772 A | | 2/1973 | Downing et al. | 15/49 |
| 3,943,591 A | | 3/1976 | Lanusse | 15/29 |
| 4,005,502 A | | 2/1977 | Stevens | 15/22 |
| 4,158,246 A | | 6/1979 | Meadows et al. | 15/28 |
| 4,168,560 A | | 9/1979 | Doyel | 15/29 |
| 4,217,671 A | | 8/1980 | Rand | 15/24 |
| 4,399,578 A | | 8/1983 | Bordeaux | 15/97 |
| 4,549,371 A | | 10/1985 | Hakoda | 51/170 |
| 4,796,321 A | | 1/1989 | Lee | 15/29 |
| 4,799,280 A | | 1/1989 | Lee | 15/29 |

(Continued)

FOREIGN PATENT DOCUMENTS

| | | |
|---|---|---|
| FR | 71124 | 10/1959 |

(Continued)

*Primary Examiner*—Shay Karls

(57) ABSTRACT

A motorized cleaning/polishing device includes a housing and a carrier with a detachable cleaning/polishing attachment. The housing contains a rechargeable battery, motor and flex mount having flexible pillars to which the carrier is mounted. The carrier is also coupled to the motor drive shaft via an eccentric element and bearing. The carrier may have a foam layer with hook fasteners adhered to its underside for removably attaching any one of various attachments to the carrier. Cleanser or polish can be impregnated in the attachment wet or dry, or it can be contained in a perforated or water dissolvable packet sandwiched between the carrier and the attachment. A removable scrub brush can also be attached to the carrier so that its bristle head orbits in front of the device. The device is particularly suited to orbit in the 2,500 to 10,000 OPM range.

2 Claims, 11 Drawing Sheets

U.S. PATENT DOCUMENTS 4,820,435 A * 4/1989 Zafiroglu ..... 510/406
4,837,981 A 6/1989 Hashii ..... 51/170
4,917,238 A 4/1990 Schumacher ..... 206/223
5,035,684 A 7/1991 Sorrells ..... 493/342
5,074,081 A 12/1991 Beth et al. ..... 51/170
5,170,588 A 12/1992 Schaal et al. ..... 51/170
5,234,615 A 8/1993 Gladfelter et al. ..... 252/90
5,381,578 A 1/1995 Armbruster ..... 15/98
5,392,568 A 2/1995 Howard et al. ..... 451/357
5,402,604 A 4/1995 Hashii et al. ..... 451/155
5,419,737 A 5/1995 Brazell et al. ..... 451/453
5,423,102 A 6/1995 Madison ..... 15/22.2
5,437,571 A 8/1995 Everts et al. ..... 451/344
5,450,646 A 9/1995 McHugh et al. ..... 15/22.1
5,470,272 A 11/1995 Kikuchi ..... 451/344
5,471,695 A 12/1995 Aiyar ..... 15/22.1
5,476,409 A 12/1995 Wada et al. ..... 451/12
5,482,499 A 1/1996 Satoh ..... 451/356
5,491,896 A 2/1996 Stolzer et al. ..... 30/169
5,493,749 A * 2/1996 Zayas ..... 15/244.2
5,495,632 A 3/1996 Baker ..... 15/4
5,511,269 A 4/1996 Watson ..... 15/22.1
5,533,925 A 7/1996 Sato ..... 451/344
5,533,926 A 7/1996 Nemazi ..... 451/490
5,558,566 A 9/1996 Hashii et al. ..... 451/157
5,595,531 A 1/1997 Niemela et al. ..... 451/357
5,607,343 A 3/1997 Keith et al. ..... 451/344
5,607,345 A 3/1997 Barry et al. ..... 451/539
5,624,302 A 4/1997 Hashii et al. ..... 451/157
5,637,034 A 6/1997 Everts et al. ..... 451/344
5,681,213 A 10/1997 Hashii ..... 451/356
5,697,115 A 12/1997 Sciarra et al. ..... 15/21.1
5,701,625 A 12/1997 Siman ..... 15/21.1
5,709,596 A 1/1998 Alexander et al. ..... 451/357
5,718,014 A 2/1998 DeBlois et al. ..... 15/22.1
5,725,423 A 3/1998 Barry et al. ..... 451/539
5,823,016 A 10/1998 Glotz ..... 68/3
5,842,913 A 12/1998 Nemazi ..... 451/499
5,855,504 A 1/1999 Hild ..... 451/357
5,860,852 A 1/1999 Hashii et al. ..... 451/157
5,881,418 A 3/1999 Enoch ..... 15/101
5,885,146 A 3/1999 Cockburn ..... 451/357
5,890,249 A 4/1999 Hoffman ..... 15/4
5,906,687 A 5/1999 Masui et al. ..... 134/1.3
5,937,475 A * 8/1999 Kasen et al. ..... 15/320
5,947,804 A 9/1999 Fukinuki et al. ..... 451/357
5,950,268 A 9/1999 Murphy et al. ..... 15/28
5,956,792 A 9/1999 Gutelius et al. ..... 15/22.2
5,978,999 A 11/1999 DeBlois et al. ..... 15/22.1
6,021,573 A 2/2000 Kikuchi et al. ..... 30/392
6,037,319 A * 3/2000 Dickler et al. ..... 510/439
6,039,639 A 3/2000 Pfaundler ..... 451/356
6,065,182 A 5/2000 Wright et al. ..... 15/353
6,099,397 A 8/2000 Wurst ..... 451/344
6,120,363 A 9/2000 Dunn ..... 451/356
RE36,909 E 10/2000 Satos et al. ..... 451/344
6,139,411 A 10/2000 Everts et al. ..... 451/359
D435,768 S 1/2001 Duffy ..... D8/62
6,179,696 B1 1/2001 Duffy ..... 451/357
6,185,781 B1 2/2001 Miller et al. ..... 15/322
6,202,242 B1 3/2001 Salmon et al. ..... 15/22.1
6,248,007 B1 6/2001 DeBlois et al. ..... 451/344
6,253,405 B1 7/2001 Gutelius et al. ..... 15/22.2
6,305,044 B1 * 10/2001 James et al. ..... 15/227
6,353,964 B1 3/2002 Andrisin et al. ..... 15/387
6,374,447 B1 4/2002 Armbruster et al. ..... 15/28
6,406,206 B1 * 6/2002 Girardot et al. ..... 401/264
6,434,774 B1 8/2002 Castellon ..... 15/50.1
6,485,360 B1 11/2002 Hutchins ..... 451/357
6,493,903 B1 * 12/2002 Super ..... 15/324
6,651,286 B2 * 11/2003 Pierce ..... 15/98
6,725,490 B2 * 4/2004 Blaustein et al. ..... 15/22.2
6,746,311 B1 * 6/2004 Kessel ..... 451/41
2002/0112741 A1 8/2002 Pieroni et al. ..... 134/6
2002/0129835 A1 9/2002 Pieroni et al. ..... 134/6
2004/0031121 A1 * 2/2004 Martin et al. ..... 15/246.2

FOREIGN PATENT DOCUMENTS

GB 1083179 A 9/1967
JP 5-95816 4/1993
WO WO0132095 A1 * 5/2001 ..... 15/22.1
WO WO02/49496 A1 6/2002

* cited by examiner

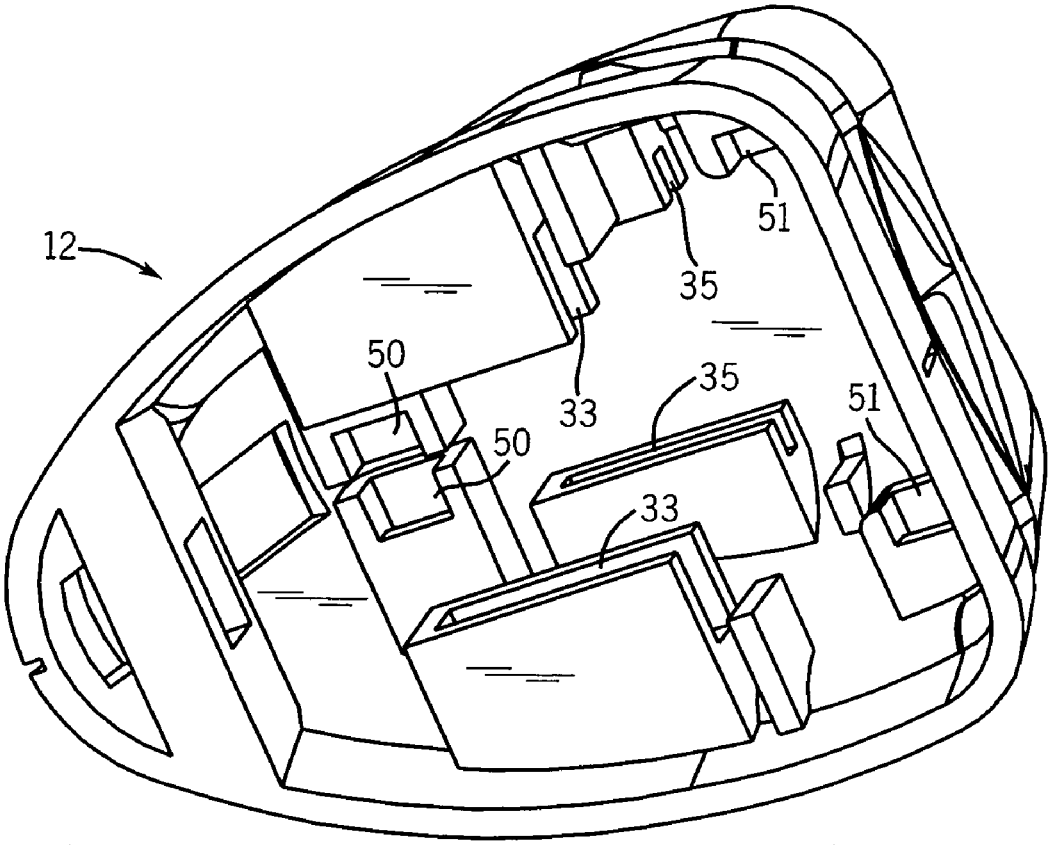
FIG. 7
FIG. 8
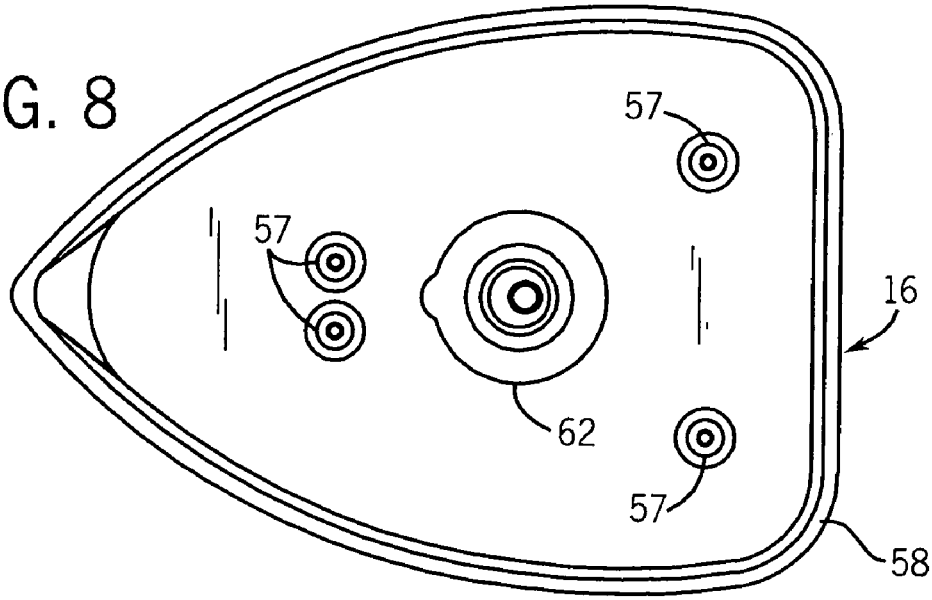

FIG. 9
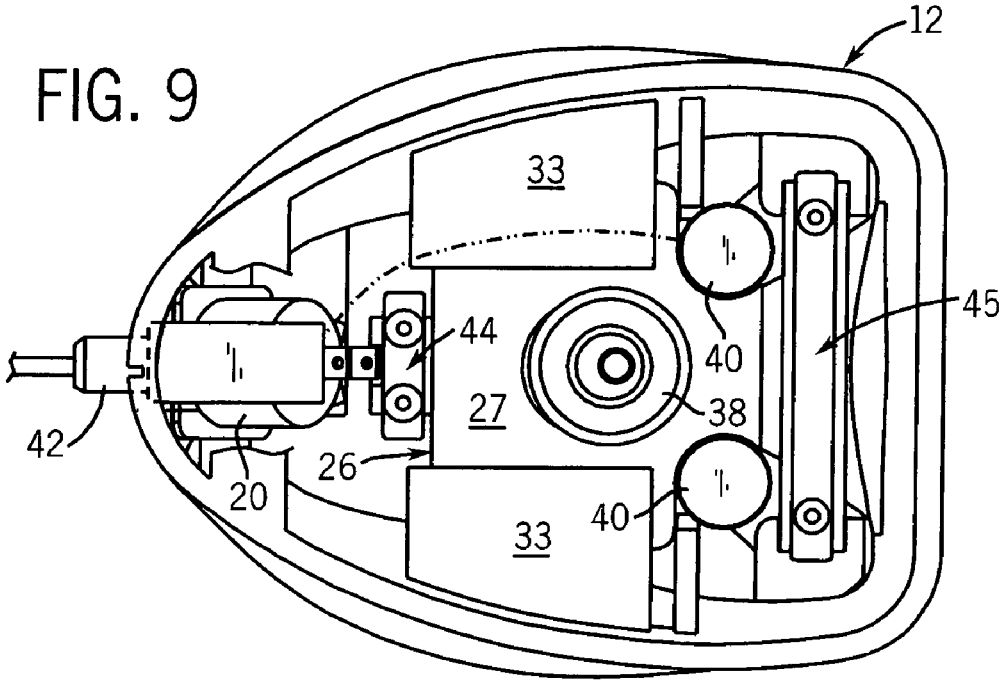
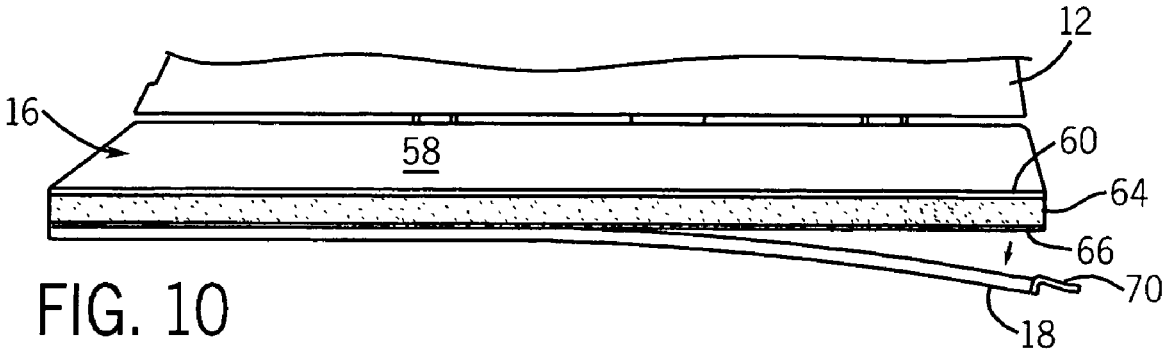
FIG. 10

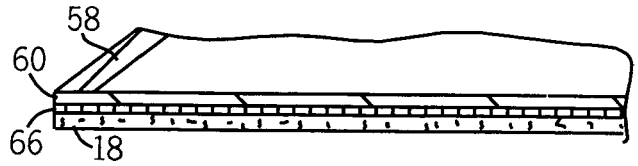
FIG. 14
FIG. 15
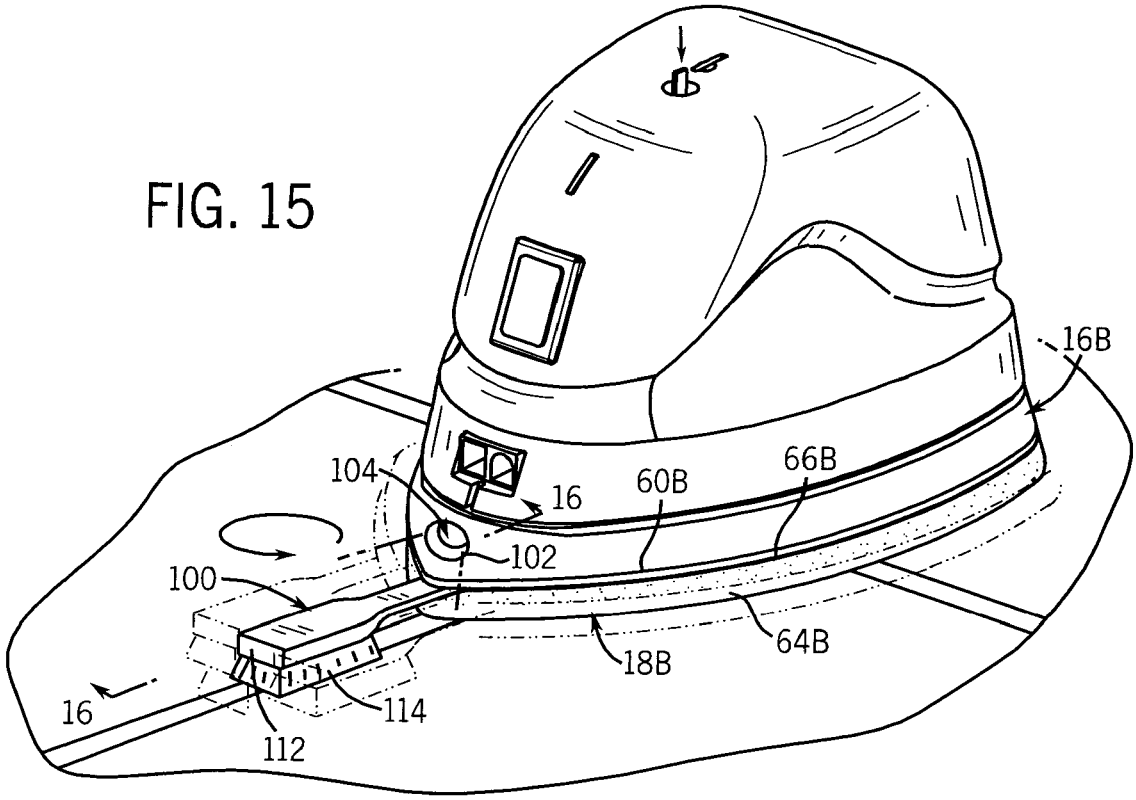
FIG. 16
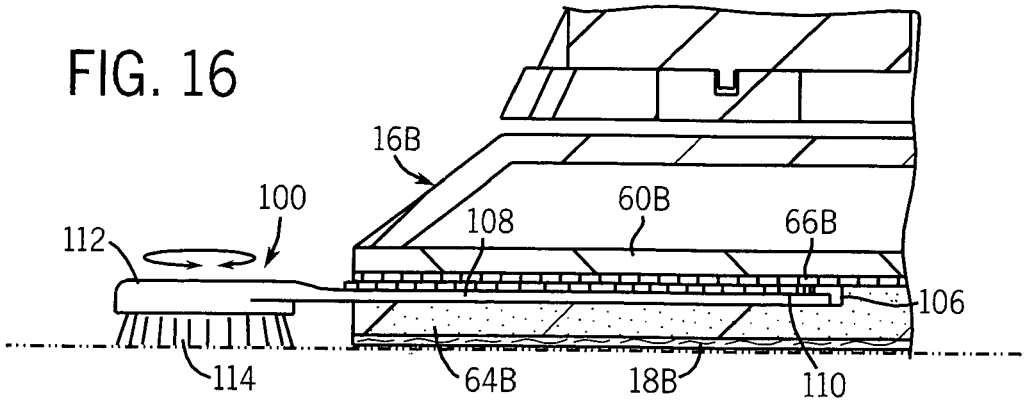

POWERED CLEANER/POLISHER

CROSS-REFERENCE TO RELATED APPLICATION

This application is based on and claims priority from provisional patent Application No. 60/430,735 filed on Dec. 3, 2002.

STATEMENT OF FEDERALLY SPONSORED RESEARCH OR DEVELOPMENT

Not applicable.

BACKGROUND OF THE INVENTION

The present invention relates to cleaning implements, and in particular to powered devices for cleaning or polishing hard surfaces, such as those commonly found in residences.

Household cleaning and polishing chemicals are well-known as is their use with sponges, brushes and pads. Powered devices have been developed to make the process of apply these chemicals easier and to provide improved treatment of heavily soiled surfaces. Some such devices are small electrically powered hand-held units. Some have rotating brush heads. See for example U.S. Pat. Nos. 4,799,280 and 4,168,560. Other devices have been developed which impart linear reciprocation and/or an orbiting motion on a cleaning head. These powered devices generally have a housing containing a drive motor with a rotating shaft that either rotates or reciprocates (in a straight or orbital path) the cleaning head using suitable coupling between the rotating drive shaft and the cleaning head.

Some of these devices attach a replaceable cleaning pad to the cleaning head, for example, using a hook and loop attachment, such as Velcro® brand fasteners (see U.S. Pat. No. 6,253,405).

Some devices are to be used with separately contained cleaning/polishing compounds applied during use to the cleaning head or directly to the surface being cleaned. Others incorporate the compounds in the device for example by pre-impregnating the heads.

Separately, it is also known to provide cleaning compositions in a water dissolvable pouch or packet. See U.S. Pat. No. 5,234,615. In this case, the packet and composition are shipped and stored dry and thus are not messy and do not evaporate. When water contacts the packet it dissolves and activates the composition. However, there is no known portable powered cleaning device which utilizes such pouches to deliver a cleaning agent to the cleaning pad.

Accordingly, improved hand-held powered cleaning devices are needed.

SUMMARY OF THE INVENTION

In one aspect the invention provides a portable powered cleaning device having a motor mounted in a housing so that a drive shaft of the motor extends adjacent a bottom opening of the housing. A carrier is coupled to the drive shaft through the bottom opening and is mounted to the housing so as to reciprocate with respect to the housing when the drive shaft is moved. A cleaning attachment is removably attached to the carrier and a packet of a surface treatment composition is disposed between the cleaning attachment and the carrier.

In one preferred form the packet is water dissolvable, for example, made of polyvinyl alcohol. Alternatively, the packet can be perforated with a peel off layer covering the perforations prior to use.

In another aspect the invention provides a portable powered cleaning device with a flex mount fixed to the housing having at least one flexible elongated member. A motor is mounted in the housing and has a drive shaft. The carrier is mounted to the flex mount and is eccentrically coupled to the drive shaft so that when the shaft is rotated the carrier reciprocate in a plane generally parallel to the bottom of the housing.

In yet another aspect the invention provides a portable powered cleaning device with both a scrub brush and another cleaning attachment. The scrub brush and attachment are mounted to the carrier to reciprocate therewith when the drive shaft is rotated. Preferably, the scrub brush is detachable from the carrier and has an elongated body disposed between the carrier and the cleaning attachment.

In preferred forms, the device is powered by a rechargeable battery disposed in the housing. A power switch is electrically coupled between the battery and the motor and an interrupt switch is coupled between the power switch and the battery. The interrupt switch is preferably pressure sensitive or placed in a location so that it can be activated during normal use by applying downward pressure on the device or by simply grasping the hand rest. Preferably, the motor operates to reciprocate the carrier between about 2,500 and 10,000 cycles per minute.

The carrier can include a substantially rigid body coupled to the drive shaft by a bearing having an outer race fixed with respect to the carrier and a plate attached to a bottom side of the carrier. A layer of foam can be adhered to an underside of the carrier plate and a hook fastener layer can be adhered to an underside of the foam layer or the carrier plate if no foam layer is provided.

The cleaning attachment can be made of woven or non-woven materials including cloth, micro-fibers, rubbers, polymers, bristles, foams and combinations thereof. The surface treatment composition can be in any physical state including liquid, gel, paste, solid and granular. The surface treatment composition is preferably a cleanser or a polish and can be any of surfactants, solvents, chelants, biocides, builders, abrasives, polymers, pH adjusters, bleaches, waxes, silicones, fluorocarbons, perfumes, dyes and combinations thereof. Depending on the particular embodiment, the surface treatment composition can be applied directly to the cleaning attachment, rather than contained in a pouch. The composition can be dried or kept moist in a liquid impermeable pouch or container prior to use.

These and still other advantages of the invention will be apparent from the detailed description and drawings. What follows are preferred embodiments of the present invention. To assess the full scope of the invention the claims should be looked to as the preferred embodiments are not intended as the only embodiments within the scope of the invention.

BRIEF DESCRIPTION OF THE DRAWINGS

Figure ("FIG.") 1 is a right frontal perspective view of a portable powered cleaning/polishing device according to the present invention;

FIG. 7 is a bottom perspective view of the device's housing, in isolation;

FIG. 8 is a top plan view of a carrier member;

FIG. 9 is a bottom plan view of the device with the carrier removed;

FIG. 10 is a partial right side view of the device of FIG. 1, showing the cleaning attachment partially removed;

FIG. 14 is a partial side view of yet another alternate version of the device in which a hook fastener is adhered directed to a bottom plate of the carrier without a foam layer therebetween;

FIG. 15 is a front right perspective view of another alternate embodiment of the invention having a removable scrub brush attachment;

FIG. 16 is an enlarged partial right side view of the device of FIG. 15;

DETAILED DESCRIPTION OF THE PREFERRED EMBODIMENTS

The present invention provides a portable motorized device particularly designed for cleaning and/or scrubbing hard surfaces, such as in kitchens and bathrooms, typically susceptible to dirt and mildew. It should be noted that the device may not only be used for cleaning, but also for buffing and polishing or otherwise treating surfaces. Various features and components of the inventive device may be discussed herein with regard to cleaning. However, this is done to simplify the discussion and is not intended to exclude other non-cleaning applications for the device.

Additionally, the term "reciprocate" as used herein means to translate back and forth in a straight line or non-straight line path. Thus, the device can operate to provide back and forth linear motion or an orbital motion resulting from translating the center of a circular path. Purely rotational motion, without translation in at least one direction, is not encompassed in the meaning of reciprocate.

Figure 1:
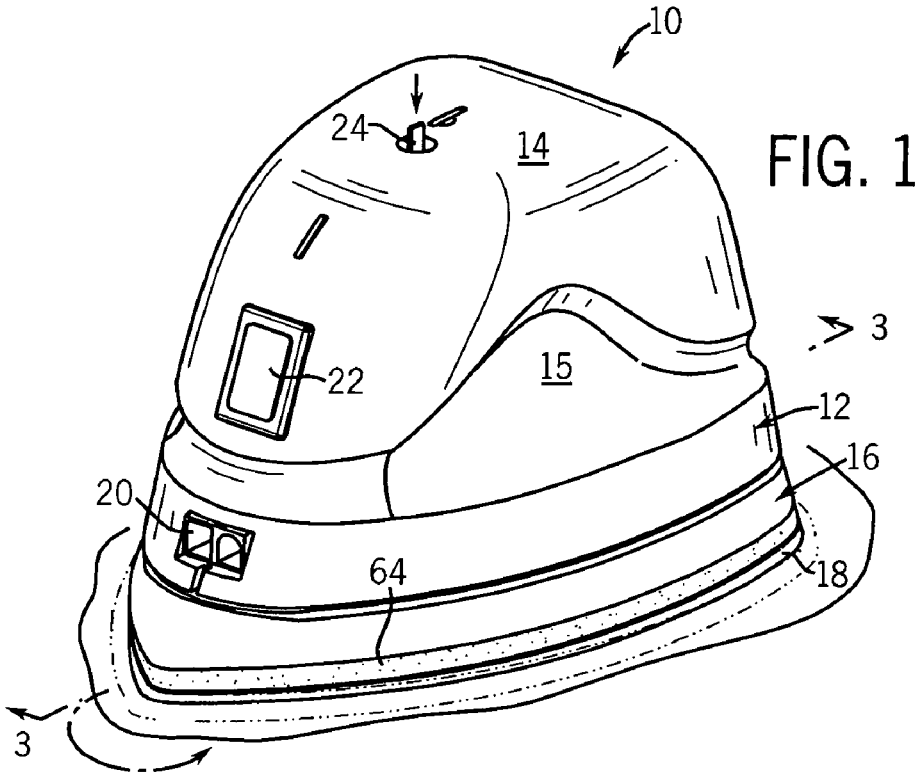
Figure 2:
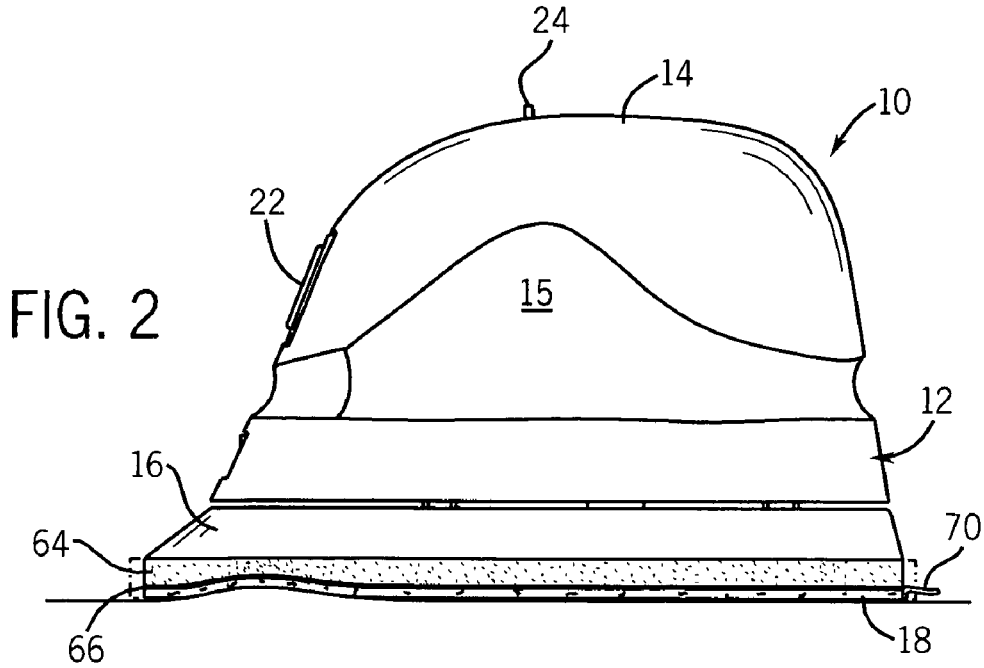
FIG. 2 is a right side view thereof.
Figure 3:
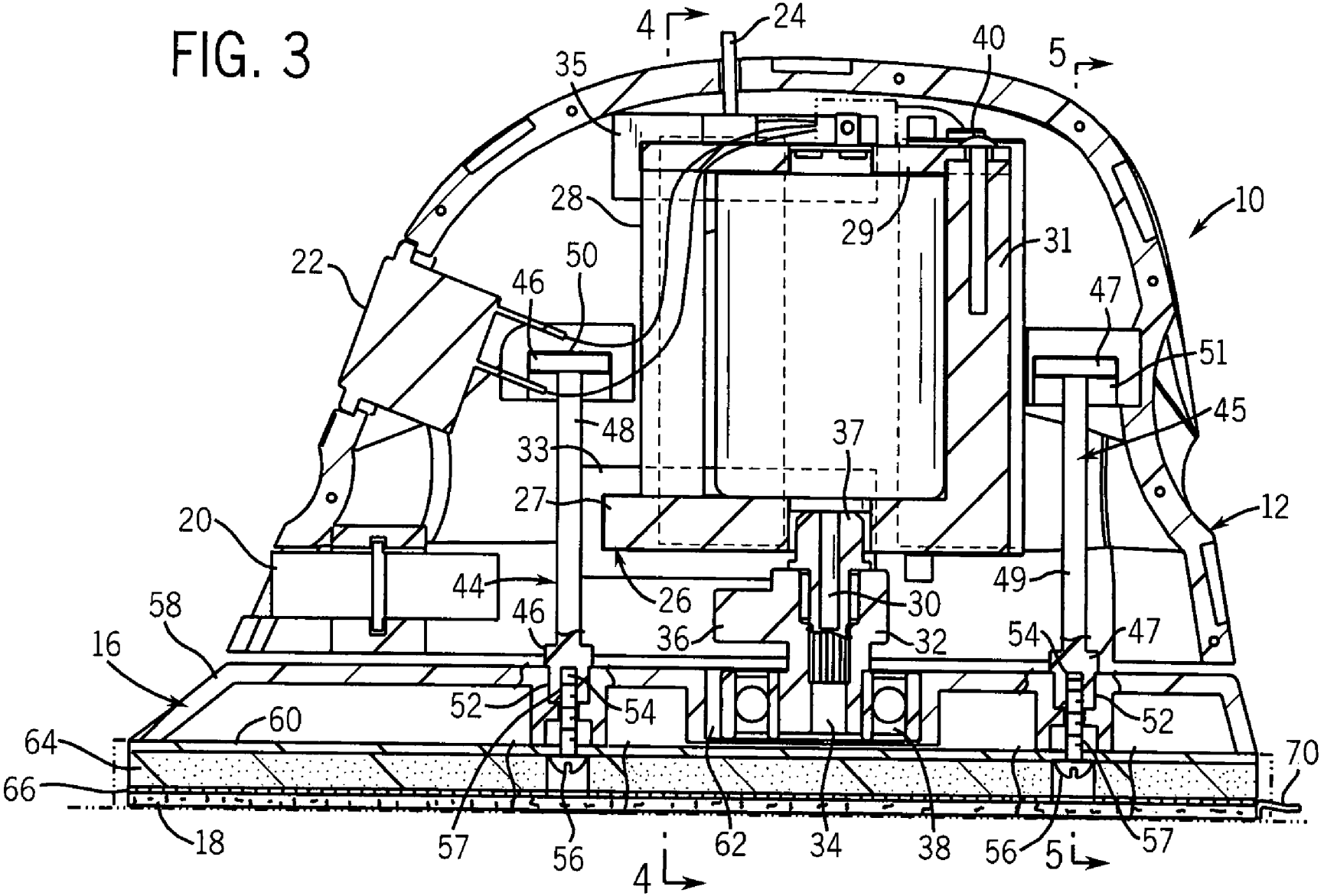
FIG. 3 is a cross-sectional view taken along line 3-3 of FIG. 1.
Figure 4:
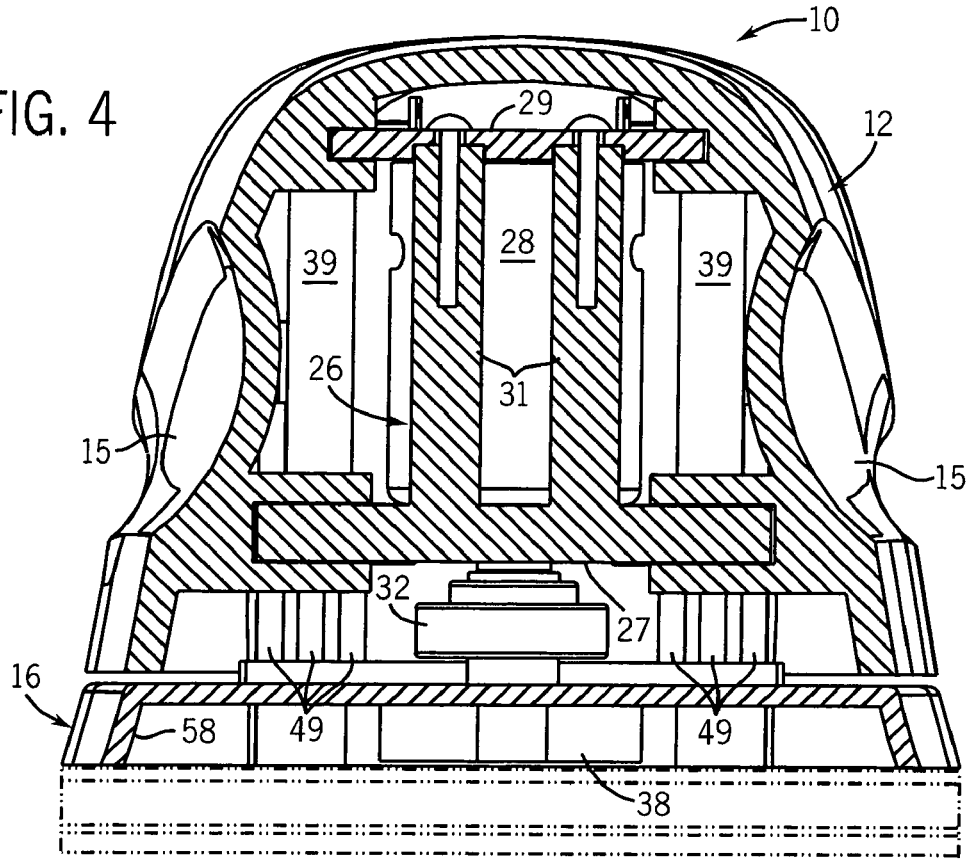
FIG. 4 is a cross-sectional view taken along line 4-4 of FIG. 3.
Figure 18:
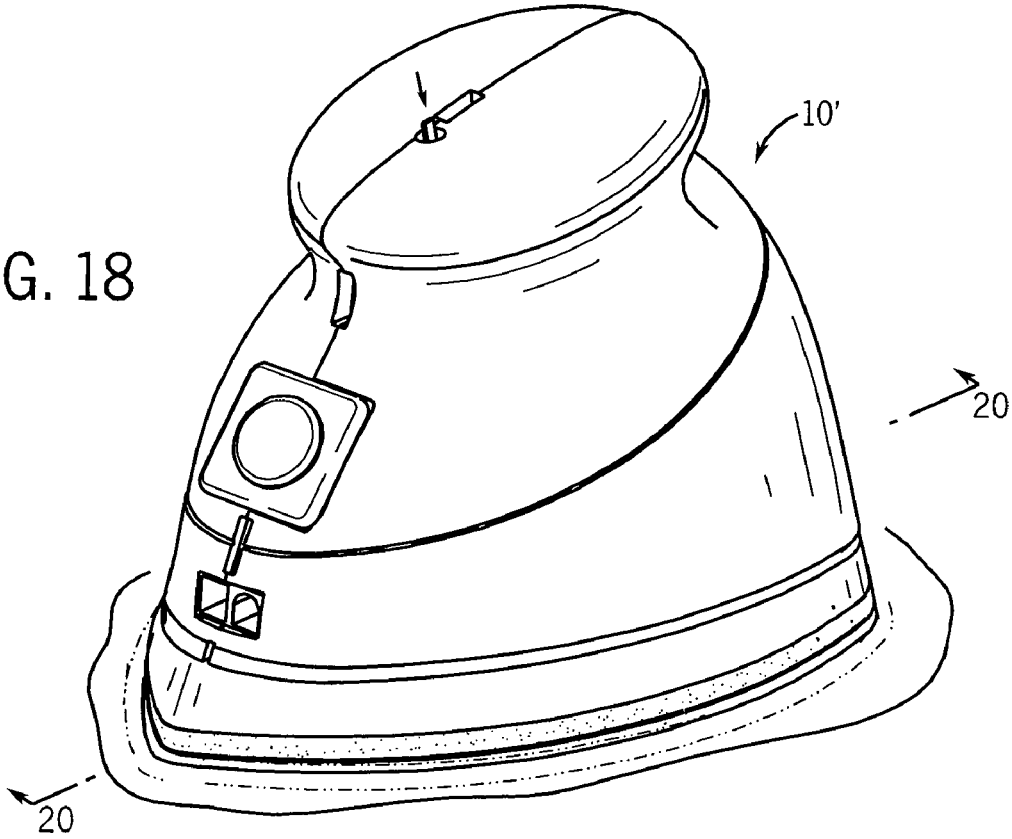
FIG. 18 is a perspective view of another embodiment of the invention having an ergonomic housing.
Figure 19:
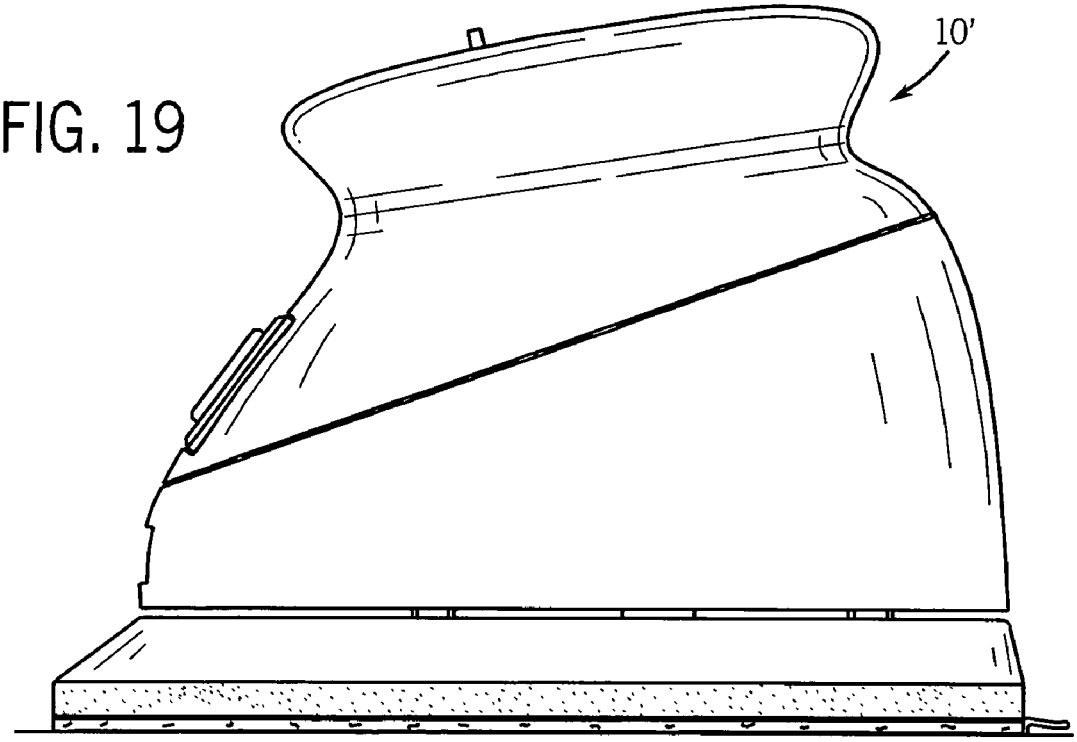
FIG. 19 is a right side view of the device of FIG. 18.
Figure 20:
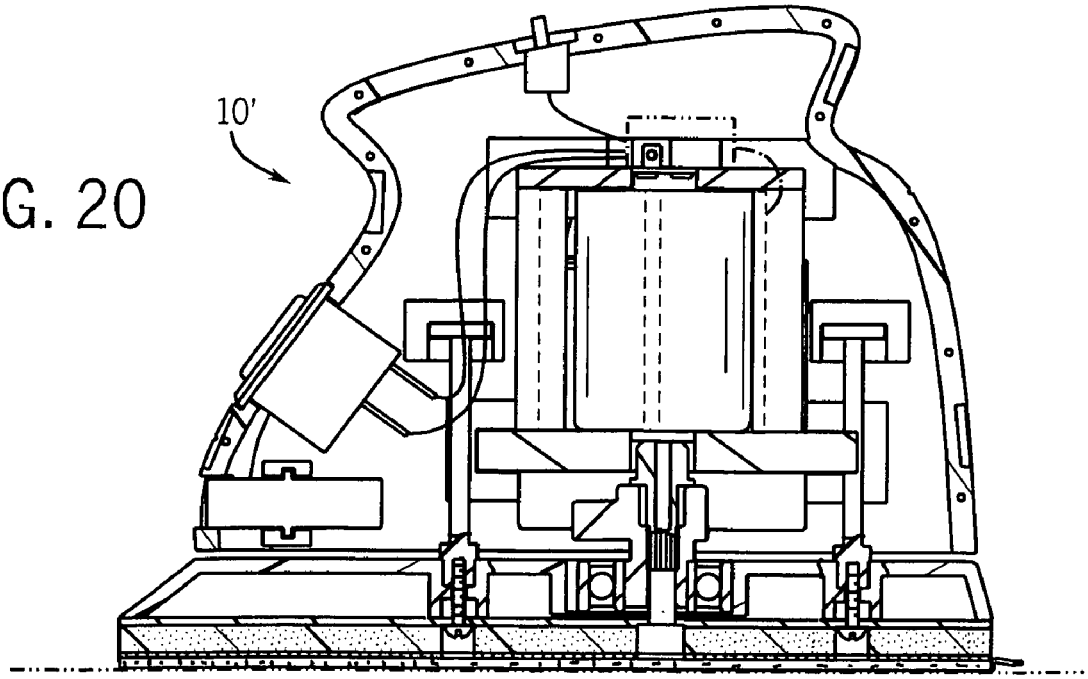
FIG. 20 is a side cross-sectional view taken along line 20-20 of FIG. 18.

Referring to FIGS. 1-3, the device 10 has an open-bottom housing 12, preferably made of a suitable plastic, defining a smooth ergonomic hand rest or grip 14 with contoured thumb rests 15 on each side for grasping the device comfortably during use with either hand. The housing 12 is compact and has a generally triangular footprint. The housing 12 contains the power and drive components (discussed below) and provides a mount for a movable carrier 16 holding a cleaning attachment 18. It has openings for a power socket 20, power switch 22 and interrupt switch 24 and optionally a frontal light (not shown in this embodiment). A battery access opening and door (not shown) could also be formed in a side, back or top of the housing. FIGS. 18-20 illustrate one example of an alternate form of the housing.

Referring to FIGS. 3-7, the power and drive components of the device reside in the housing on mount 26, which has a base 27 connected to a top plate 29 by three uprights 31. The mount 26 is fixedly supported inside the housing 12 by two lower 33 and two upper 35 supports formed integrally with the housing to extend inwardly (see FIGS. 4 and 7). The supports define slots that capture edges of the base 27 and top plate 29. The mount supports a DC motor 28 between the base 27 and top plate 29 in an inverted fashion with the drive shaft 30 extending vertically downward through an opening in the base 27 of the mount 26 at or near the open bottom of the housing 12.

A set screw (not shown) secures a shaft adapter 37 onto the drive shaft which mounts an eccentric element 32 having a bore 34 radially offset from the centerline of the eccentric element 32. The eccentric element 32 also includes an integral (although it could be separate) counterbalance 36 extending radially to the side of the eccentric element 32 opposite the offset of the bore 34 so as to counter the moment produced by rotation and reduce vibration during use. A roller bearing 38 is press-fit onto (or otherwise attached to) the free end of the eccentric element 32.

The motor mount 26 also has two battery clips 39 which support and retain a pair of batteries. The batteries could be non-rechargeable batteries, such as alkaline cells, but preferably the batteries are rechargeable, such as nickel cadmium ("NiCad") cells or lithium ion cells.

The embodiment shown in FIGS. 1-10 has 2 AA sized 1,000 milliamp hours ("mHr") NiCad cells. This power source is preferred for a low speed application in which the carrier orbits at about 3,500 orbits per minute ("OPM") when not loaded and about 2,900 OPM when loaded. The embodiment of the device 10' shown in FIGS. 18-20 has three Sub-C sized 2,000 mHr NiCad cells (and thus three battery clips (one shown)), which is preferred for higher operating speeds of about 6,500 OPM before loading and about 5,800 OPM when loaded. These values are provided herein merely for illustrating specific exemplary operating parameters. However, any suitable DC motor 28 can be used which operates between about 1,000 to 11,000 revolutions per minute on 3-9 volts. Moreover, while the device can operate satisfactorily at about 1,000 to 11,000 OPM, a more preferred range is 2,500 to 10,000 OPM, an even more preferred range is 2,500 to 8,500 OPM and a still more preferred range is between 3,000 and 6,000.

In any case, the batteries 40 are electrically connected to the motor 28 as well as the terminals of the power chord socket 20, which accepts a power chord 42 (as shown in FIG. 9) for recharging the batteries 40 (when rechargeable cells are used).

The power switch 22, preferably a water impermeable membrane covered toggle or push button switch, is electrically connected between the motor 28 and the batteries 40 with the push button interrupt switch 24 interposed therebetween at one leg of the switch 22. The two switches thus must be closed to complete the circuit between the motor 28 and the batteries 40. The interrupt switch 24 can be located anywhere on the housing 12 so that it is easily tripped during use, preferably without requiring a separate motion. For example, the stem of the interrupt switch 24 can protrude through an opening (preferably sealed within an o-ring (not shown)) in the hand rest 14 of the housing 12 so that it is depressed when one places his or her hand on the device as one would during normal use. This switch 24 could also be a pressure sensitive switch placed near the bottom of the housing 12 or in the carrier 16 and activated in response to downward pressure applied to the device.

Figure 5:
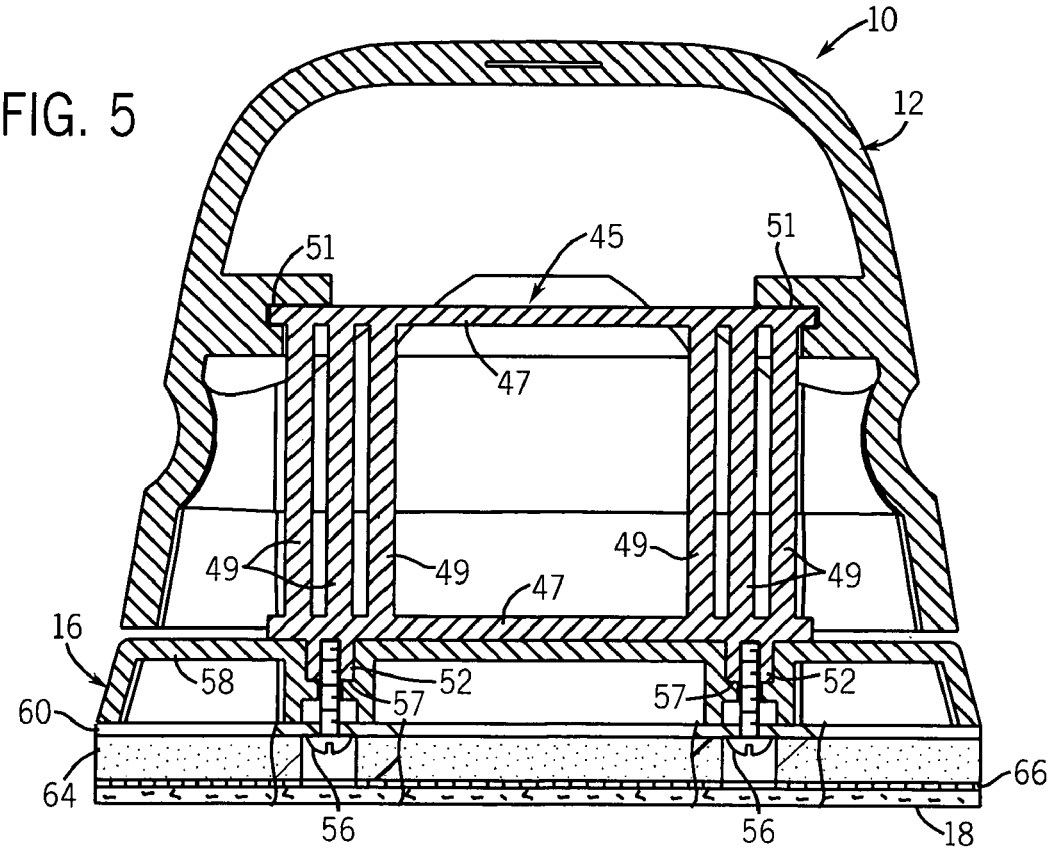
FIG. 5 is another cross-sectional view albeit taken along line 5-5 of FIG. 3.
Figure 6:
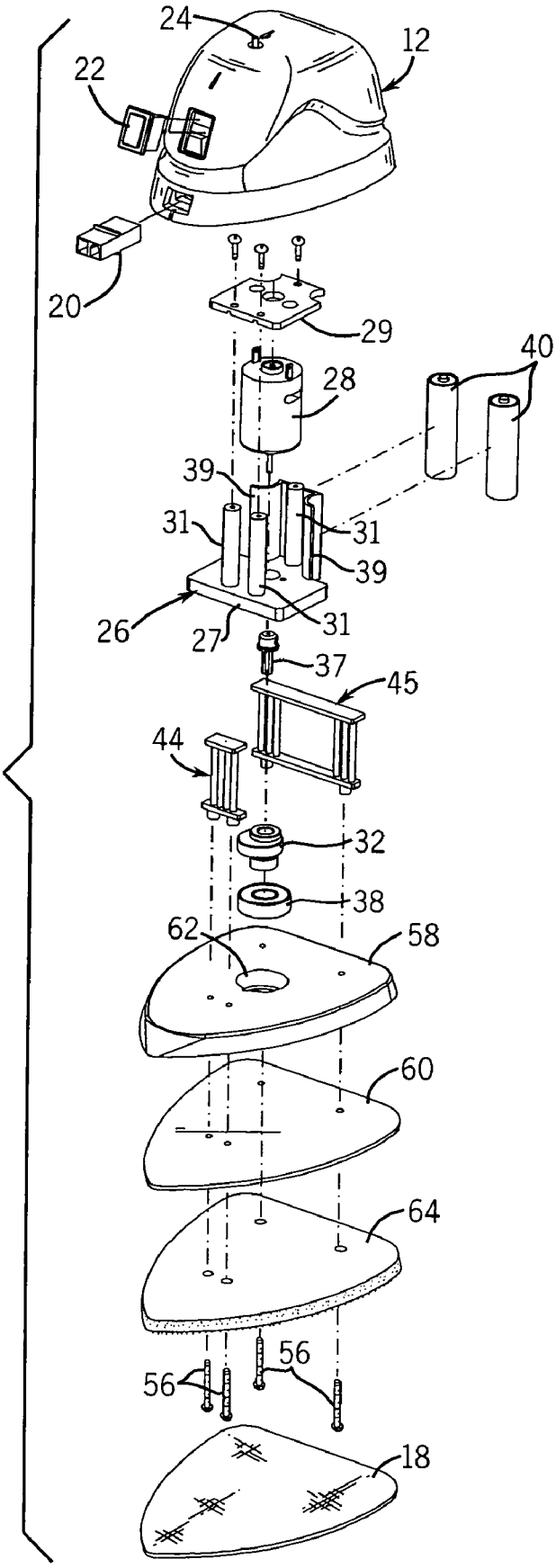
FIG. 6 is an exploded perspective view of the device of FIG. 1.

Referring to FIGS. 3 and 5-6, the housing 12 also contains two carrier mounts 44 and 45. The carrier mounts 44 and 45 somewhat resemble Roman numerals, with carrier mount 44 resembling a Roman numeral "I" and carrier mount 45 resembling Roman numeral "II". Carrier mount 44 has short planar top and bottom cross-members 46 with four flexible elongated pillars 48. Carrier mount 44 has longer top and bottom cross-members 47 and two sets of three flexible pillars 49.

Ends of the top cross-members pop into grooved recesses formed integrally with the housing 12 so that the carrier mounts are suspended from the housing 12. Carrier mount 44 connects to the housing 12 at recesses 50 toward the front of the device and carrier mount 45 connects at recesses 51 both of which open downward and at inner sides. The cross-members are preferably a generally rigid plate or bar (able to flex somewhat during assembly) and the flexible pillars are preferably a flexible plastic or hard rubber to allow them to flex without buckling when downward pressure is applied to the device.

Each carrier mount 44 has two circular bosses 52 defining threaded bores 54. The bosses 52 fit into corresponding recesses 57 in a main body 58 of the carrier 16 and fasteners 56 secure the carrier 16 to the flex mounts. The main body 58 is also formed with a larger central recess 62 receiving the roller bearing 38 such that its outer race is press-fit into the recess 62 and thus fixed with respect to the carrier 16. A bottom plate 60 encloses the bottom side of the carrier body 58. When assembled, the carrier 16 is spaced slightly down from the bottom of the housing 12 so that its movement is not obstructed.

The described arrangement provides for orbital movement of the carrier 16 when the motor 28 is operated. Specifically, energizing the motor 28 causes the shaft 30 to rotate, which in turn rotates the eccentric element 32 with the inner race of the bearing 38. The carrier 16 is prevented from rotating with the shaft 30 because of the flexible connection to the housing 12 by mounts 44. The offset bore 34 in the eccentric element 32 causes the bearing 38, and thus the carrier 16, to move radially as the shaft 30 is rotated since the outer race of the bearing 38 is fixed in the recess of the carrier body. The carrier 16 thus moves in a generally elliptical orbit about the shaft 30 in a plane generally parallel to the bottom of the housing. Preferably, the eccentric element 32 is sized so that the carrier and cleaning attachment travel approximately 2-30 millimeters ("mm") during orbiting, with a more preferred range being 3-15 mm and a still more preferred range being 4-14 mm.

In a preferred form, a suitable closed-cell foam layer 64 generally 3-30 mm thick (preferably about 5 mm) is adhered to the underside of the bottom plate 60 and a layer of a hook fastener 66, such as one part of a conventional Velcro® brand fastener, is adhered to the underside of the foam 64. A looped upper surface of the cleaning attachment 18 engages the hook fastener 66. The cleaning attachment can be peeled off of the carrier 16 by separating the loops from the hooks, preferably by pulling the cleaning attachment 18 from the carrier 16 via tab 70 (see FIG. 10). The hook and loop attachment technique is an accepted technique for securely and removably attaching a pad or sheet to a rapidly reciprocating substrate.

As shown in FIG. 14, the foam layer 64 could be omitted such that the hook fastener 66 was adhered directed to the bottom plate 60. The foam 64 is generally preferred, however, to allow the cleaning attachment 18 to conform to curved, convex or pitted surfaces being cleaned (see FIG. 2). It should also be noted that while the foam layer is shown as having a flat underside, it could define convex curves at the edges or anywhere through its extent.

Figure 21:
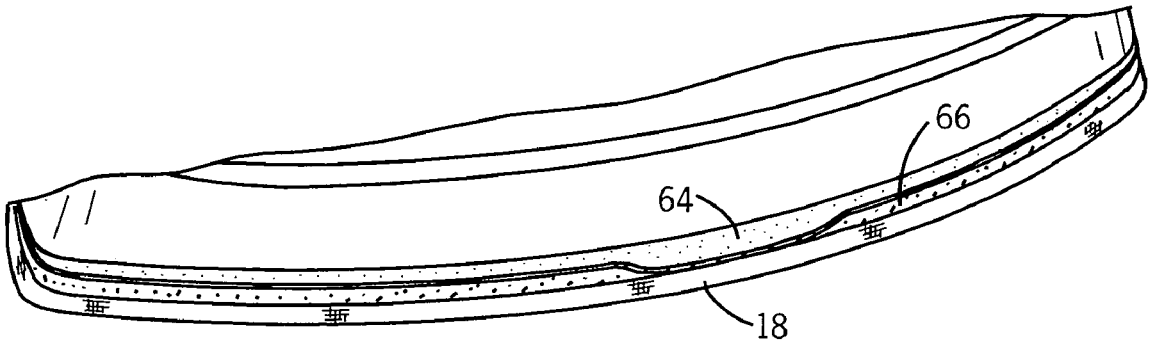
FIG. 21 is a partial perspective view showing another form of the device in which the cleaning attachment wraps around the bottom of the device.

It should be noted also that, as shown in FIG. 21, the layer of hook fastener 66 could be adhered not only to the underside of the foam layer 64 or the carrier plate 60, but could wrap around the bottom edges and extend along the vertical or angled side edges of these components. The cleaning attachment 18 could then be sized slightly larger than the undersurface of these components so it could wrap around these components and provide side or edge cleaning surfaces, particularly suited for cleaning the corners where a floor and wall meet.

Figure 11A:
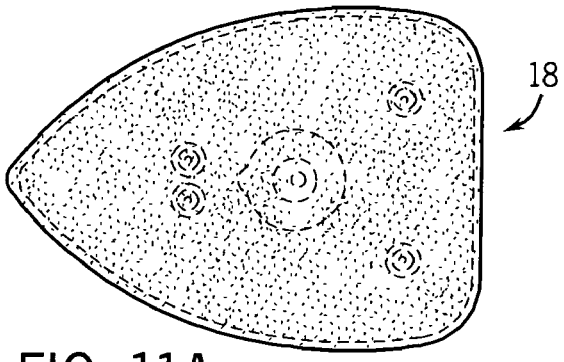
FIGS. 11A-11D show alternate constructions of the cleaning attachment.
Figure 11B:
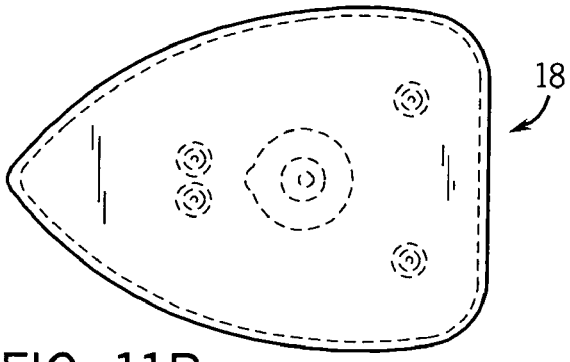
Figure 11C:
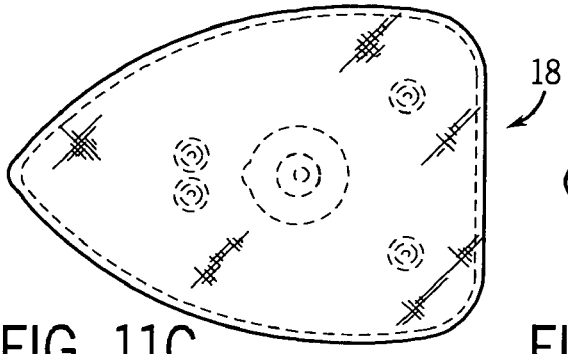
Figure 11D:
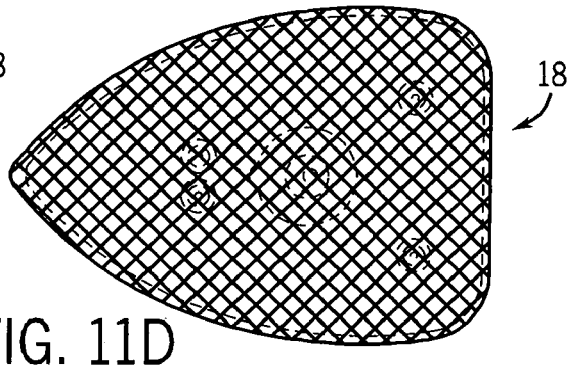

As illustrated in FIGS. 11A-11D, the cleaning attachment 18 can be made of any woven or non-woven material. For example, FIG. 11A represents a foam or sponge type material; FIG. 11B represents a generally smooth non-woven cellulosic material such as nylon and rayon or possibly a dusting sheet such as a Pledge® Grab-it®; FIG. 11C represents a cloth material, the fiber coarseness of which can be varied to be made more suitable for scrubbing or polishing/buffing as desired; and FIG. 11D represents a polymeric fiber scrubbing pad. As noted, these are examples of some selected material compositions, however, any suitable material can be used. The attachment can also include highly absorbent polymers for better liquid absorption. Further, the attachment may have a polyethylene and/or polypropylene composition selected to achieve a desired abrasiveness and flexibility.

In any event, preferably, the attachment is formed with its own looped backing material, as know in the art, which can act as the loop half of a Velcro® system to engage the hook layer. It may be necessary, or desired, to adhere or otherwise join a sheet (or one or more strips) of the loop half of a Velcro® system to the attachment.

The present device can be used with any suitable cleaning/polishing composition, however, preferably they are designed to clean or polish hard surfaces, such as sinks, counters, floors, cabinets and other surfaces in kitchens or floors, sinks, tubs, shower surrounds, plumbing fixtures and mirrors in bathrooms. They can be specifically targeted to treat surfaces made of particular materials, such as ceramic, porcelain, glass, wood and other natural and synthetic materials.

The formulations, for example, may include: surfactants, solvents, chelants, biocides, builders, abrasives, polymers, pH adjusters, bleach, waxes, silicones, fluorocarbons, perfumes, dyes and combinations thereof. The physical form of the composition may be liquid, solid, gel, paste or granular.

Examples of suitable cleaning compositions include:

EXAMPLE 1

Bathroom Cleaning Composition

| | |
|---|---|
| A. Moist: | |
| Water | 96.9-98.29% |
| Nonionic surfactant | 3-7% |
| Glycol ether | 2-6% |
| Fragrance | 0.1% |
| Citric/Lactic acid | 2-4% |
| B. Dry: | |
| Water | 1-6% |
| Nonionic surfactant | 36-38% |
| Glycol ether | 40-42% |
| Citric/Lactic Acid | 16-17% |
| Fragrance | 2% |

EXAMPLE 2

All Purpose/Kitchen Cleaning Composition

| | |
|---|---|
| A. Moist: | |
| Water | 85-95% |
| Surfactant | 1.5-5% |
| Glycol ether | 1-7% |
| Chelant | 0.1-1.5% |
| Fragrance | 0.1-0.5% |
| Caustic soda for pH adjustment | |
| B. Dry: | |
| Water | 5-10% |
| Surfactant | 45-55% |
| Glycol ether | 15-35% |
| Chelant | 5-15% |
| Fragrance | 1-5% |
| Caustic soda for pH adjustment | |

Figure 12:
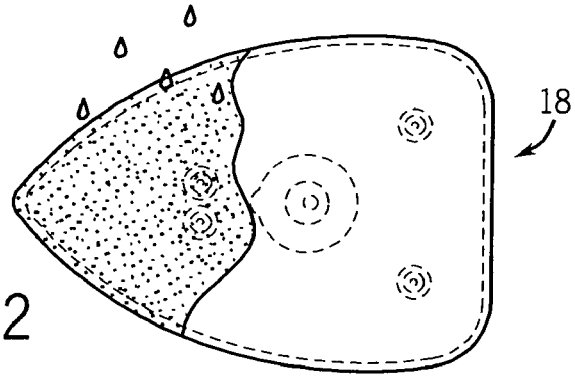
FIG. 12 shows a dry cleaning attachment impregnated with a surface treatment composition in which the composition is activated by water.

The cleaning composition can be applied to the cleaning attachment by any suitable technique. For example, it may be impregnated in the attachment and stored in either a dry or moist state (note that both are preferably initially applied to the cleaning attachment when liquid). Dry impregnated attachments may be preferred to some because they are dry to the tough and non-evaporative. The dry composition is activated on first use by water (as illustrated in FIG. 12).

Figure 13A:
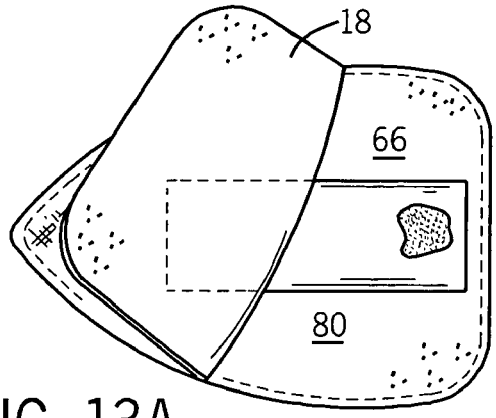
FIGS. 13A and 13B show variations in which the cleaning composition is contained in a packet located between the cleaning attachment and the carrier, FIG. 13A showing a water dissolvable packet and FIG. 13B showing a perforated packet with a peel-off seal.
Figure 13B:
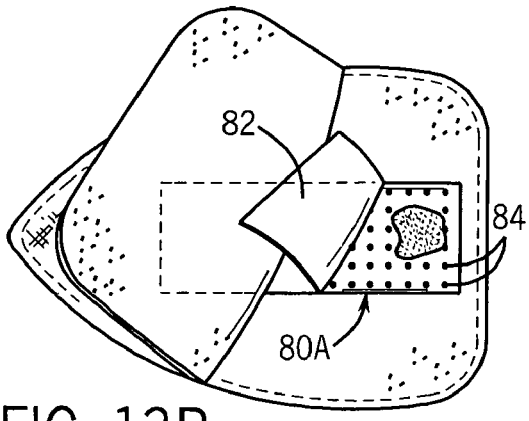

The cleaning composition may alternatively be provided in a pouch or packet 80, as shown in FIGS. 13A and 13B. In the embodiment of the invention shown in FIG. 13A, the composition is dry and the packet 80 is water dissolvable, made for example of a suitable water soluble polyvinyl alcohol. Preferably, the packet 80 is sold and stored dry and then placed between the carrier and the attachment for use. The packet will dissolve and the cleanser will be activated by contact with water.

In the embodiment shown in FIG. 13B, the packet 80A is perforated and has a peel-off layer 82 adhered to it to cover the perforations 84 before use. In this embodiment, the packet need not be dissolvable and the cleaning composition may be liquid or a gel. Pressure from use will cause the gel to pass through the perforations and into the cleaning attachment during use. When expended, the packets can simply be recycled and replaced.

While these are preferred delivery techniques, it is of course possible to use separately contained cleanser or polish or to incorporate an onboard compartment for the cleanser that could be pumped and sprayed through a nozzle from the device or forced through openings in the carrier directly to the attachment.

FIGS. 15 and 16 illustrate another preferred embodiment of the invention having a protruding scrub brush 100. In this embodiment, the internal power, drive and mounting components (not shown) are identical to that described above as is the carrier 16B. The housing 12B is also identical expect for the additional provision for a lamp opening 102 in the front in which preferably a high power light emitting diode ("LED") 104, as known in the art, is disposed for illuminating the surface in front of the device being scrubbed by the scrub brush 100. The LED 104 is powered by the batteries and is preferred over other types of lamps due to its high output per power consumption. Other lamps could of course be used and this feature could be included in any of the other embodiments described herein.

This embodiment of the invention varies from the aforementioned versions primarily in the modifications to the cleaning attachment 18B required to account for mounting the scrub brush 100. In particular, the hook fastener 66B is adhered directly to the underside of the carrier bottom plate 60B. The cleaning attachment 18B includes the layer of foam 64B which has loops at its top side and the cleaning/polishing material at its underside. This structure can be a laminate of separate layers adhered together or manufactured integrally with each other as a monolithic unit. In any case, a tunnel 106 is formed in the foam layer to accept an elongated handle 108 of the scrub brush 100. A strip 110 of mating loop material is adhered to the handle 108 to attach the scrub brush 100 to the carrier 16B. Thus, the scrub brush will orbit with the carrier and cleaning attachment when the motor is energized. Preferably, the brush head 112 extends out in front of the device with its bristles 114 extending downwardly at least to the plane the cleaning attachment or even farther to reach into crevices in the surface being cleaned. The scrub brush can be removed from the device for manual scrubbing or when it is simply not needed.

Figure 17:
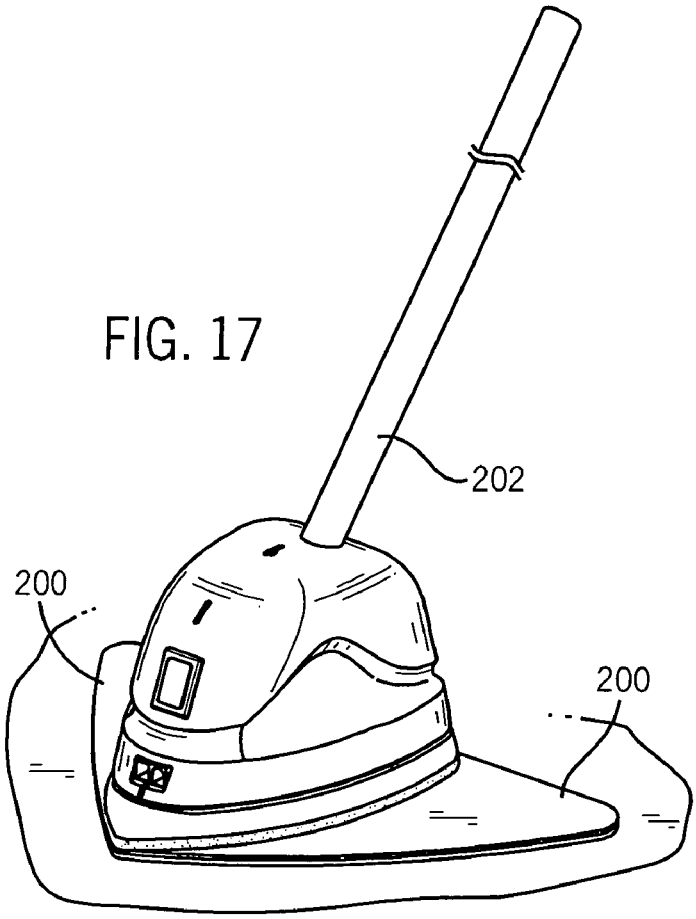
FIG. 17 is perspective view of floor cleaning/polishing embodiment of the invention, which is the FIG. 1 embodiment modified to accept an extension handle and having a wider cleaning attachment.

All of the most preferred embodiments of the invention described so far have included a generally triangular cleaning attachment about the same size as the footprint of the carrier. As shown in FIG. 17, however, the invention also contemplates a floor cleaning/polishing version of the device in which the cleaning attachment 18C is much wider than the housing so as to treat a wider swath of floor per pass. Preferably, the cleaning attachment is supported at its top side either by a correspondingly shaped bottom plate for the carrier or rigid wings 200 or ribs that are part of the attachment. In any case, this version of the device includes an elongated broom type handle 202 connected to the housing in any suitable manner, such as a threaded socket molded into the housing. The carrier and cleaning attachment of this embodiment (as in all other embodiments of the invention) could be rectangular, to resemble a conventional mop head, or any other suitable rectilinear or curvilinear shape.

It should be appreciated that the embodiments of the invention described above are merely preferred examples of practical constructions of the invention. Many modifications and variations to these preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The invention provides an improved powered cleaning device.

We claim:

1. A portable powered cleaning device, comprising:

a housing having a lower opening;

a battery powered motor mounted in the housing, the motor having a drive shaft;

a carrier coupled to the motor so as to reciprocate with respect to the housing;

a cleaning attachment removably attached to the carrier; and a scrub brush having bristles mounted separately from and external to the cleaning attachment and mounted to the carrier to be able to reciprocate therewith in an orbital path when the drive shaft is rotated, wherein the scrub brush includes an elongated body disposed between the carrier and the cleaning attachment.

2. The device of claim 1, wherein the scrub brush is detachable from the carrier.

* * * * *